10/22/85 OR 4,548,281

United States Patent [19]

Bodine

[11] Patent Number: 4,548,281

[45] Date of Patent: Oct. 22, 1985

[54] APPARATUS AND METHOD FOR INSTALLING WELL CASINGS IN THE GROUND EMPLOYING RESONANT SONIC ENERGY IN CONJUNCTION WITH HYDRAULIC PULSATING JET ACTION

[76] Inventor: Albert G. Bodine, 7877 Woodley Ave., Van Nuys, Calif. 91406

[21] Appl. No.: 599,969

[22] Filed: Apr. 13, 1984

Related U.S. Application Data

[63] Continuation-in-part of Ser. No. 348,880, Feb. 16, 1982, Pat. No. 4,471,838.

[51] Int. Cl.[4] ..... E21B 7/18; E21B 7/20; E21B 7/24

[52] U.S. Cl. ..... 175/55; 166/249; 175/56; 175/67; 175/323; 175/395; 299/17

[58] Field of Search ..... 175/55, 56, 67, 323, 175/393, 394, 395; 166/249, 177; 299/17

[56] References Cited

U.S. PATENT DOCUMENTS

| | | | |
|---|---|---|---|
| 1,959,174 | 5/1934 | Moore | 175/67 |
| 3,076,513 | 2/1963 | Hephy | 175/55 |
| 3,251,424 | 5/1966 | Brooks | 175/56 |
| 3,312,295 | 4/1967 | Bodine, Jr. | 175/56 x |
| 3,379,263 | 4/1968 | Bodine, Jr. | 175/55 X |
| 3,384,188 | 5/1968 | Bodine, Jr. | 175/55 |
| 3,406,524 | 10/1968 | Blenkarn et al. | 175/56 X |
| 4,389,071 | 6/1983 | Johnson, Jr. et al. | 175/67 X |

*Primary Examiner*—George A. Suchfield
*Attorney, Agent, or Firm*—Edward A. Sokolski

[57] ABSTRACT

A well casing to be installed in the ground is resonantly driven at a sonic frequency by means of an orbiting mass oscillator. A wedging probe member is optionally attached to the end of the casing and is driven by the vibratory energy to facilitate the penetration of the earthen material ahead of the casing. A closure wall is fitted to the bottom of the casing, this closure wall having jet nozzles formed therein. While the casing member and probe member are being vibratorily driven by the sonic energy, pulsating jets of water are emitted through the jet nozzles to aid in the cutting of the earthen formation along with the sonic vibratory energy, the sonic energy markedly enhancing the hydraulic jet action by virtue of the pulsating force it imposes on the hydraulic jets.

14 Claims, 9 Drawing Figures

APPARATUS AND METHOD FOR INSTALLING WELL CASINGS IN THE GROUND EMPLOYING RESONANT SONIC ENERGY IN CONJUNCTION WITH HYDRAULIC PULSATING JET ACTION

This application is a continuation in part of my application Ser. No. 348,880 filed Feb. 16, 1982 now U.S. Pat. No. 4,471,838.

This invention relates to the driving of well casings into the ground and more particularly to a method and apparatus employing sonic energy in conjunction with hydraulic jet action to more effectively achieve such driving action.

In my U.S. Pat. Nos. 3,354,968 issued Nov. 28, 1967; 3,375,884 issued Apr. 2, 1968 and 3,384,188 issued May 21, 1968 various methods and apparatus for sonicly driving well casings into the ground are described. It has been found that with such prior art type casing drive techniques, often a core of earthen material will build up inside the casing which makes for a high friction effect particularly as the depth of penetration into the earth increases. It therefore is essential in such techniques of the prior art that a bore hole be drilled prior to the installation of the casing even in the case of relatively shallow wells installed in relatively soft ground. The need for initially drilling a bore hole greatly increases the cost and time needed to sink the well casing. There are a number of instances, particularly in the case of shallow oil fields, where many closely spaced wells are needed where the expense of first drilling a bore hole is not justified. Shallow oil fields tend to be in alluvial and unconsolidated earth formations which are not difficult to penetrate. This type of earthen structure is also present in many subsea sediments encountered in offshore oil fields.

The present invention provides means for installing a well casing without the prior drilling of a bore hole to accommodate such casings particularly useful for installing casings in shallow wells and subsea wells and other situations where softer earthen formations are encountered.

This end result is achieved in the present invention by employing hydraulic action in conjunction with sonic action in driving the casing into the ground, the hydraulic action being achieved by pulsing jets of water which precede the casing and cut into the formation to form a "pre-bore" into which the casing can be simultaneously driven.

It is therefore an object of this invention to enable the driving of the well casings without first drilling a well bore in certain well installations.

It is a further object of this invention to combine hydraulic jet action with sonic action in the installation of a well casing.

Other objects of the invention will become apparent as the description preceeds in connection with the accompanying drawings of which, FIG. 1 is an elevational view illustrating a first embodiment of the invention.

Figure 1:
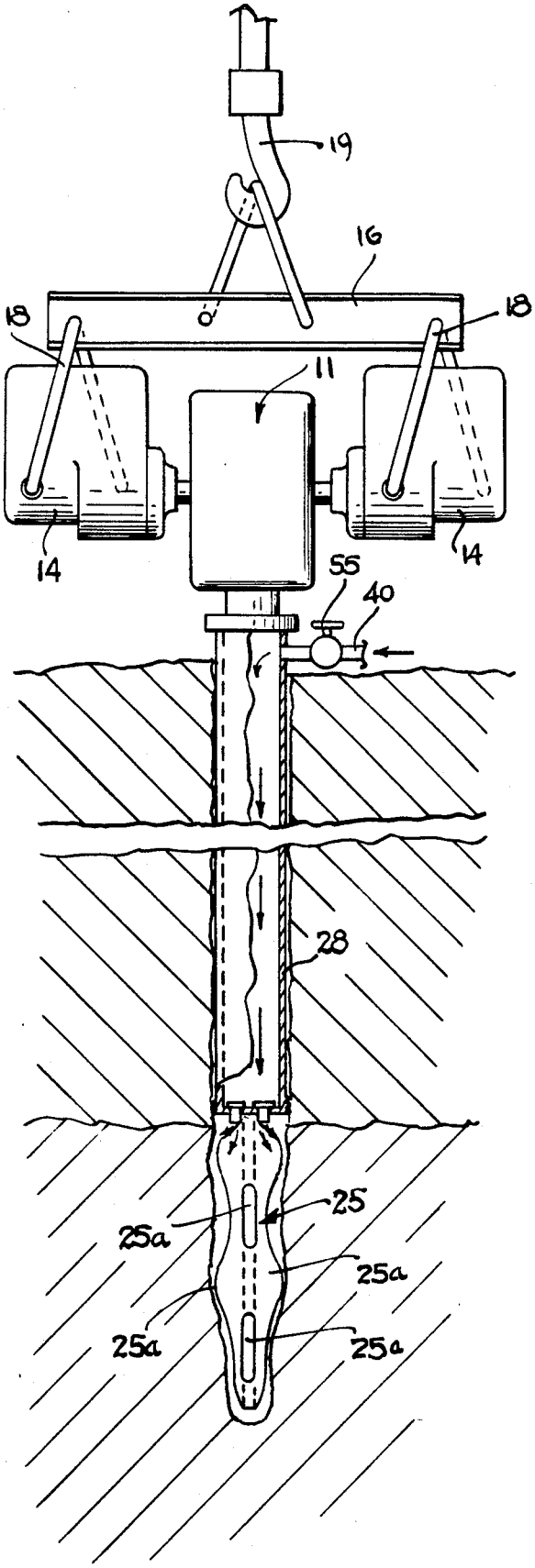
FIG. 1A is a blown up cross-section view illustrating the hydraulic jet action in the first embodiment.
FIG. 1B is a cross-sectional view taken along the plane indicated by 1B—1B in FIG. 1A.

Briefly described the apparatus and technique of the invention employs an orbiting mass oscillator which sonicly drives the casing, there being a closure plug member which closes off the bottom of the casing, this plug member having a plurality of jet orifices formed therein. Some arrangements employ additionally an optional penetration wedge member fitted on the bottom of the casing along with said closure. Water is fed into the casing at high pressure while the sonic energy is applied to the casing wall preferably at a frequency such as to cause elastic standing wave vibration of the casing, including any wedge member attached to the end of the casing, as well as the water column within the casing. High pressure water jets are intermittently jetted through the orifices in the plug member at the lower end of the casing into the earthen material below the casing; the water jets driving against the formation in pulsating fashion in view of the pulsing action engendered in the casing by virtue of the sonic energy. The vibratory action of the resonant sonic energy causes the pressurized jets of water to periodically accelerate so as to quickly penetrate and cut the earthen material. On each vibratory up stroke of the plug member at the bottom of the casing a violent suction is created thereunder and the water blast from the inside is greatly augmented, causing violent cutting and extreme turbulance and mixing of the earthen material to form a "soupy" consistency earthen mixture. During the down stroke of the vibratory cycle, the pressurized jetted liquid continues to be injected into the voids produced in the formation causing rapid break up and transportation of the earthen material. This pulsating jet action is further aided by the use of the rigidity of the closure wall across the bottom of the thin wall casing in which the relatively small jet orifices are formed, this rigid plug or closure wall forming an effective hydraulic "thumper".

It is significant to recoginize that unlike the situation in pile driving where it is desired that the pile be tightly held in the earthen material, in the present instance, the thin wall casing must remain loose and free in the bore hole to facilitate its penetration therein to the full depth of the well (usually several hundreds or thousands of feet). In the present invention, a large volume of liquid is always introduced, this being typically of the order of hundreds of gallons per minute so as to cause a substantial portion of the displaced earthen material to be injected sidewise into the natural interstices in the earthen formation which have been opened up by the vibratory jet cutting action. While the use of fluid jets particularly in connection with rotary bits and oil well drilling is well known in the art, such prior techniques do not combine and enhance the water jet action with sonic pulsating energy which causes the water jets to hit with extreme velocity and in a series of pulses which inpact like a series of jack hammer blows against the earthen formation. It is to be noted that the jet orifices are typically only ½ inch in diameter, such that the cross-sectional area of the casing is typically 50 times the combined cross-sectional area of all the nozzles. The hydraulic pressure on the inside of the casing is generally of the order of several hundred pounds per square inch to assure a heavy average flow and a rigid internal liquid column to provide high pressure peaks for the hydraulic jet impulses. It is also to be noted that the number of standing waves set up in the liquid column is substantially greater than those set up in the steel casing in view of the fact the speed of sound in the liquid is about ¼ of that in steel such that for a given frequency of vibration, a substantial difference in wave length will occur in the two media.

Figure 1A:
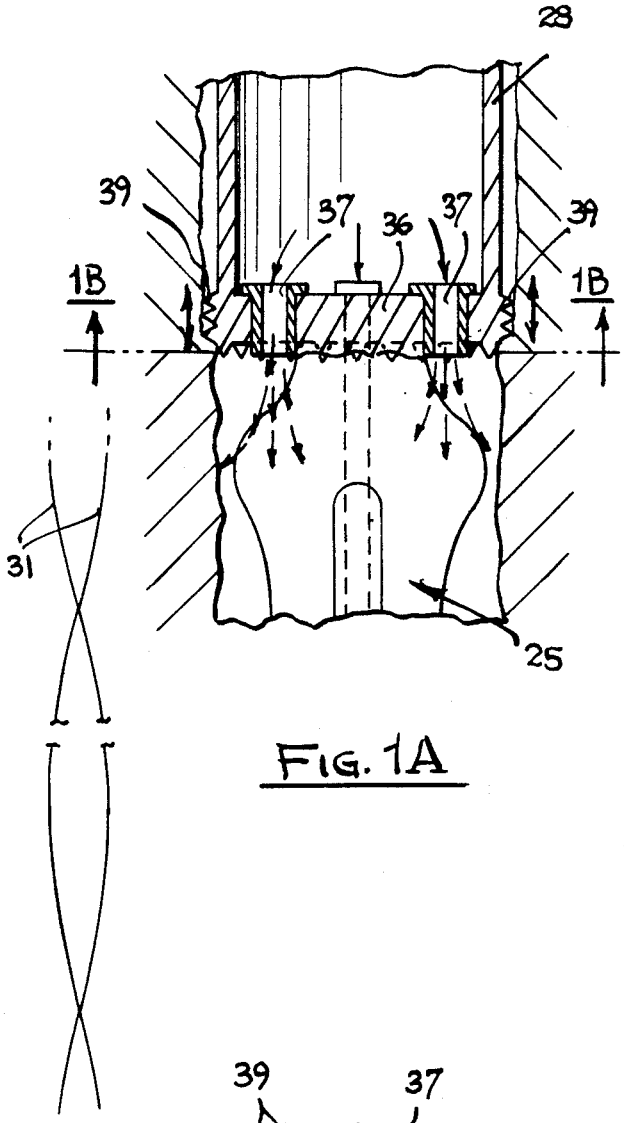
Figure 1B:
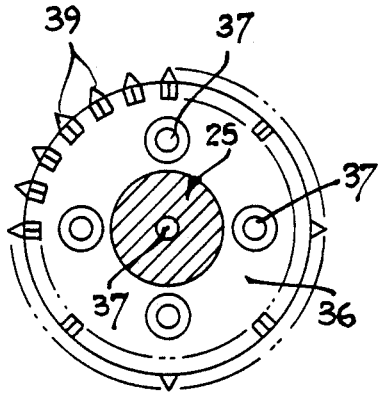

Referring now to FIGS. 1, 1A and 1B a first embodiment of the invention is illustrated. The embodiment of FIG. 1 is similar in configuration to the embodiment of FIG. 2 of my co-pending application Ser. No. 348,880 of which the present application is a continuation in part; this except for the addition of the hydraulic jet nozzle mechanism which as already noted is a essential part of the present invention. Sonic oscillator 11 comprises orbiting masses formed by paired eccentric rotors which are driven by engines 14, as described in my U.S. Pat. Nos. 3,189,108 and 3,684,037. The oscillator-engine assembly is suspended from support beam 16 by means of suspension struts 18, beam 16 in turn being suspended from the hook 19 of a derrick (not shown).

Casing member 28 which is being driven into the ground is suspended from the casing flange of oscillator 11 by suitable clamp means (not shown). Fixedly and rigidly attached to the bottom of casing 28 is wedging tool 25 which is fabricated of a strong material such as aluminum. Extending outwardly from the sides of tool 25 are a plurality of rib members 25A, these rib members being arranged in opposing pairs which are spaced circumferentially from each other around the tool at intervals of 90 degrees. A closure plate 36 is integrally formed with casing 28 at the bottom thereof, penetrating wedge member 25 being fixedly joned to the closure plate. A plurality of jet orifices 37 are formed in closure member 36. Closure 36 and wedging tool 25 are conveniently of aluminum so as to be drilled away if desired upon completion of driving. Teeth 39 are formed around the perifery of closure member 36 to facilitate the making of a clearance in the formation so that some of the fluid and cuttings will tend to come to the surface on the outside of the casing. This also frees the casing from the formation so that it is better able to penetrate and tends to have a higher "Q" in its standing wave vibration. This clearance also facilitates cementing the casing in place upon completion of the driving operation.

In operation, the rotors of oscillator 11 are driven by engines 14 at a speed such as to set up elastic standing wave vibration in casing 28 including wedging member 25 as indicated by standing wave pattern 31. Liquid is fed into casing 28 from line 40 through valve 55 so as to establish a pressure head at the bottom of the casing which typically should be the order of several hundred pounds per square inch. The sonic energy will also tend to cause standing wave vibration in the liquid column.

The end result is a vibratory wedging action by wedging member 25 which precedes the casing and fractures the earthen formation, this action being aided by high pulses of liquid which emanate from jets 37 to enhance the cutting action. The earthen material is mixed into a slurry which can readily move to the top of the well along the sides of the casing. Moreover the closure member 36 vibrates against the liquid soaked formation below it, thus aiding in the disintegration of the formation and operating in the nature of a hydraulic "thumper". The earthen formation 32 is thus subjected to pulsating vibratory forces as well as hydraulic forces which enable the penetration of a bore hole in advance of the casing.

Figure 2:
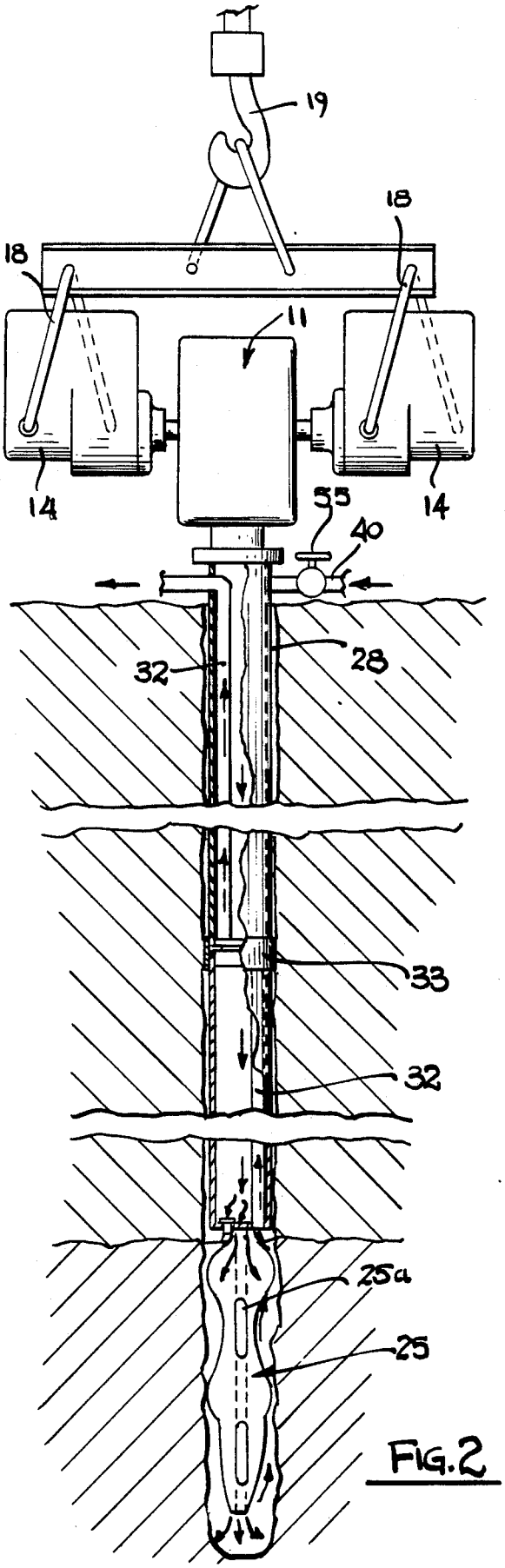
FIG. 2 is a elevational view illustrating a second embodiment of the invention.
Figure 2A:
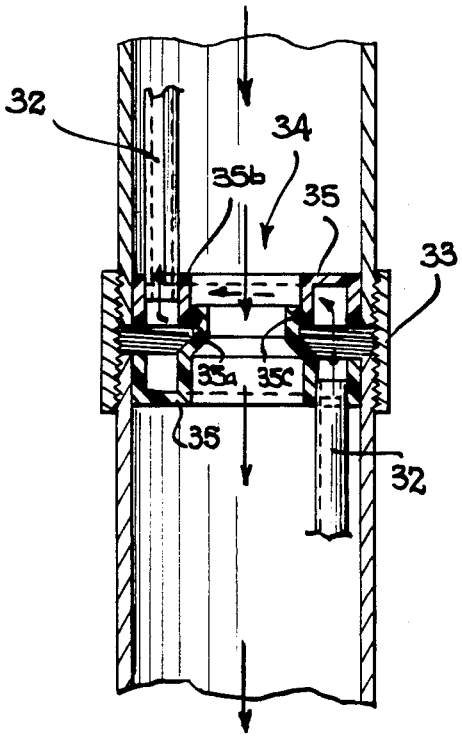
FIG. 2A is a blown up cross-sectional view illustrating a mating manifold structure that can be employed to join together pipe sections in the second embodiment.
Figure 2B:
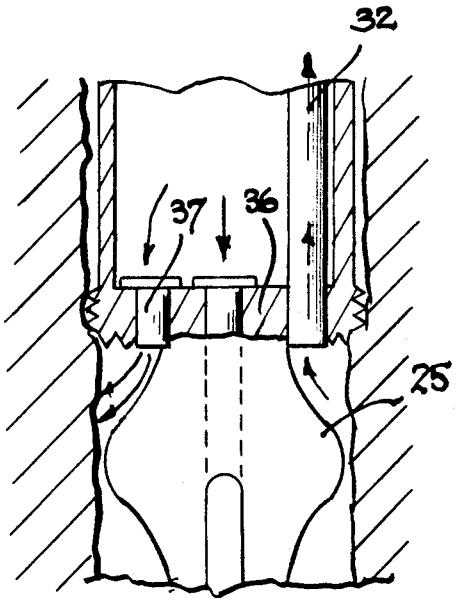
FIG. 2B is a blown up view illustrating the hydraulic jet action and the hydraulic removal action in the second embodiment.

Referring now to FIGS. 2, 2A and 2B a second embodiment of the invention is illustrated wherein the fluid and cuttings are brought to the surface through a separate discrete conduit rather than along the sides of the casing as in the previous embodiment. The internal conduit 32 is provided for this purpose. This conduit is installed along the inner walls of casing sections 28. Assembled into each casing joint 32 and cemented in place therein in assembly 34 for interconnecting sections of conduit 32 together. Each assembly 34 includes a manifold 35 to which the conduits sections 32 are connected as for example by press fitting or cementing, the manifold 35 (which may be glued in place) being annular and operating to provide a fluid interconnection between the sections of conduit. As can best be seen in FIG. 2A, the manifolds have alternate male and female flanges 35A and 35B with an O-ring 35C therebetween such that when the casing joints are screwed together, a fluid type connection is provided. The manifold is annular to assure continuous fluid connection from conduit section to conduit section even though the conduit pipes are not lined up directly above each other. The manifolds and conduit pipes can be polyvinylchloride plastic which is easily drilled out entirely later on. The driving operation of this embodiment is as for the previous embodiment. The cuttings and fluid enter the bottommost conduit 32 as illustrated in FIG. 2B and flow up the successive conduit sections, and are finally outletted at the surface as shown in FIG. 2.

Figure 3:
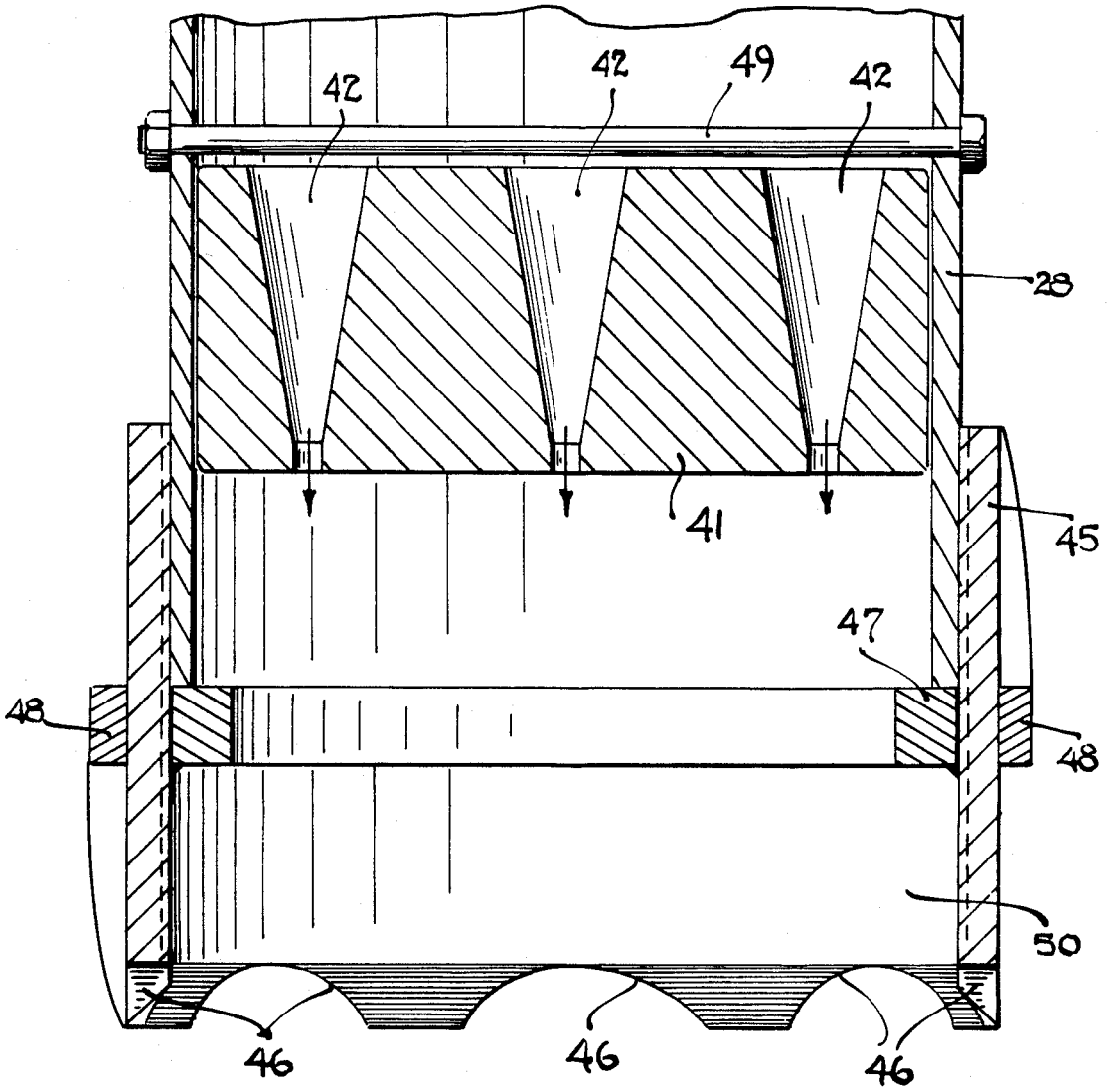
FIG. 3 is a cross-sectional view illustrating an alternative form of the orifice and bottom closure plug structure of the invention.
Figure 3B:
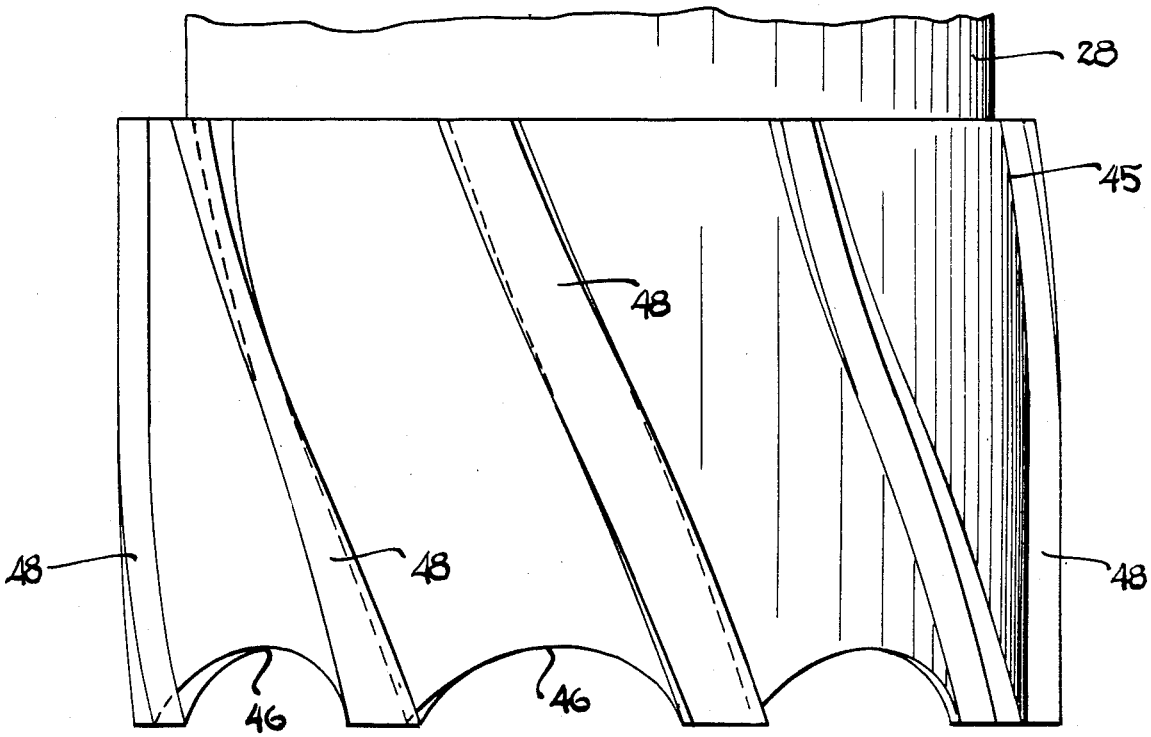
FIG. 3B is a side elevational view of the device of FIG. 3.
Figure 3A:
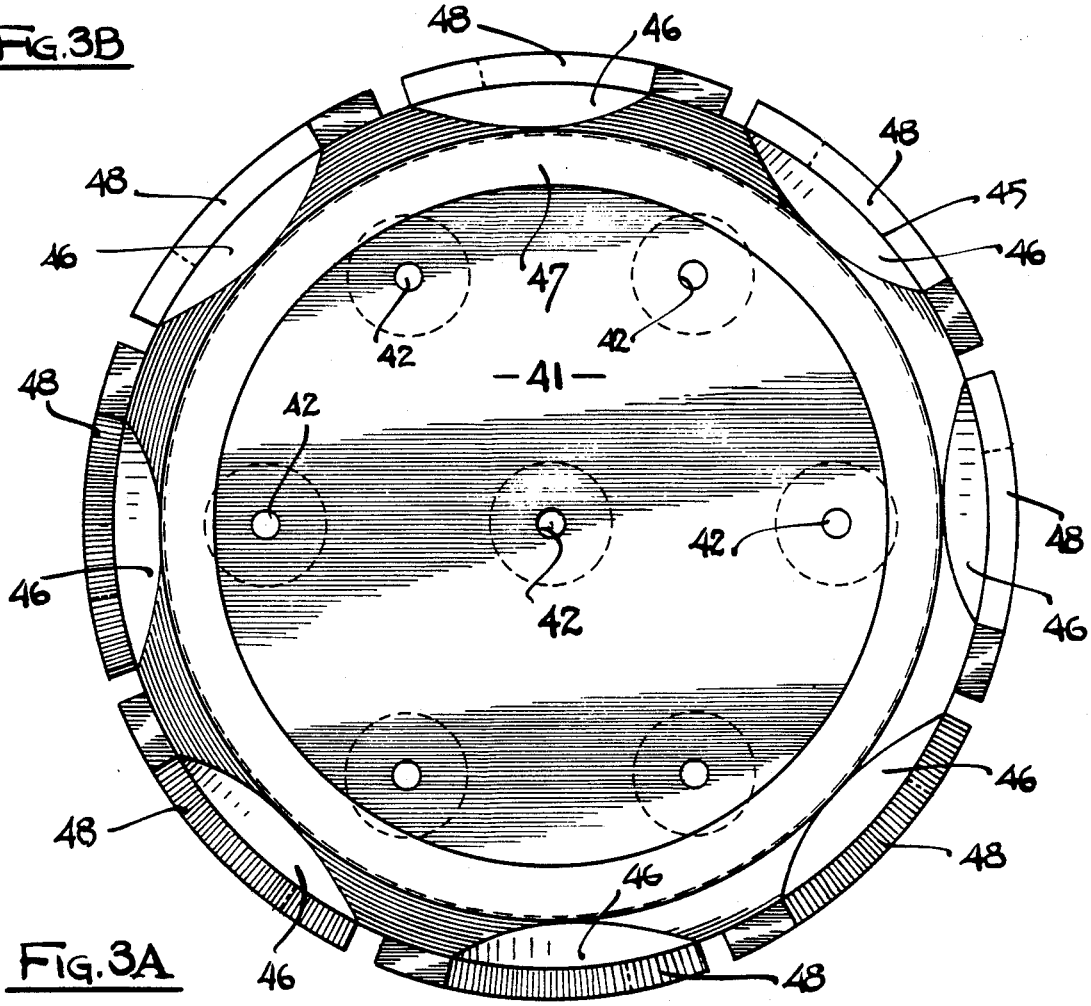
FIG. 3A is a bottom plan view of the device of FIG. 3.

Referring now to FIGS. 3, 3A and 3B an alternate configuration for the orificed bottom closure plug structure is illustrated. This configuration is very desirable for a wide range of formation hardness. Closure plug 41 which is cylindrical in form has a plurality of tapered orifices 42 formed therein and is slidably fitted into the bottom end of casing 28. The tapering of orifices 42 provides maximum downward velocity for the fluid jets emitted from the orifices, along with minimal clogging from detritous from below. Cylindrical collar member 45 is threadably attached to the bottom of casing 28. A stop ring 47 is welded to the inside wall of collar 45 and operates to limit the downward travel of plug 41. Cross-bolt 49 extends through casing 28 and limits the upward travel of the plug. Collar 45 has a plurality of scalloped cutouts 46 formed around its lower edge to permit outward egress of wash liquid emitted from jet orifices 42. To further aid the passage of wash fluid up around the outside wall of the casing helically angled flute bars 48 are welded to the outside surface of the collar. Upward passage of fluid is provided in the spaces between the flutes fluid travels upward to the surface in the space between the casing and the bore hole as in the embodiment of FIG. 1.

In operation, the high internal water pressure in the casing tends to hold plug 41 down against stop ring 47 for a substantial portion of each vibration cycle. Operation with lower water pressure on the other hand may permit plug 41 to move up against bolt 49 during a substantial portion of each cycle. Thus the size of the space 50 below plug 41 can be made to vary during operation.

In operation of the system, the elastic wave vibration of casing 28 causes the collar 45 to operate as a very active annular sonic cutting shoe action with minimal damping restriction by the "free" plug 41 and with flute bars 48 forming a bore hole larger than the casing so as to enable the upward flow of wash fluid along the outer wall of the casing. With this more annular type drilling action, a core like formation remnant tends to enter space 50, this core material then tending to be cut up considerably by the action confined within the collar so it can be fairly easily eroded by the hydraulic jet action through nozzles 42. This cored out earthen material is also broken apart by impacts from the bottom surface of plug 41. In this manner the vibrating action of plug 41 does not have to contend with a strong solid earthen formation. The lower edge of collar 45 performs the initial and leading penetration action into the earthen formation. For the penetration of firmer formations, it is preferable to position bolt 49 higher on the casing to permit a greater lattitude of stroke. In such situations, where a particularly hard core condition is encountered, plug 41 will be free to move up away from the core rather than being tighly abutted thereagainst during the vibratory action. In this matter undo damping of the elastic wave vibration of the casing is avoided. When dealing with softer formations, the core cavity can be made smaller by positioning bolt 49 lower along the casing which enables the plug to speed up the digging action by being more actively involved with the casing vibration. Further a lower location of nozzles 42 will sometimes speed up the penetration of earthen material in the region of flutes 46.

While the invention has been described and illustrated in detail, it is to be clearly understood that this is intended by way of illustration and example only and is not to be taken by way of limitation, the spirit and scope of the invention being limited only by the terms of the following claims.

I claim:

1. A method for installing a casing in an earthen formation comprising installing a plug member on the bottom end of said casing to be driven into the formation, said plug member having jet nozzles formed therein, generating sonic energy by means of an orbiting mass oscillator, feeding liquid into the casing to establish a pressure head against said plug member, and applying said sonic energy to the casing to cause vibration thereof such that the liquid is driven from said jet nozzles in pulses in response to the sonic vibration of said casing and said plug members while the casing is vibratorily driven against the formation such that the liquid jet action and vibration of said casing against the formation simultaneously erode said formation ahead of said casing.

2. The method of claim 1 wherein said liquid is water.

3. The method of claim 1 wherein said sonic energy is at a frequency suach as to set up elastic standing wave vibration of said casing and said liquid.

4. The method of claim 1 and additionally including the step of installing a conduit within said casing to carry earthen material mixed with liquid to the surface.

5. The method of claim 1 and further including installing a wedging member at the bottom end of said casing and extending axially ahead of said casing for aiding in the break up of the earthen formation.

6. A system for installing a well casing in an earthen formation comprising a plug member attached to one end of said casing and forming a cover for said one end, said plug member having a plurality of jet nozzles formed therein, said one end of said casing being placed against the formation for penetration therein, means for generating vibrational energy at a sonic frequency, means for feeding liquid into said casing to form a fluid pressure head against said plug member so as to cause the emission of said liquid from said nozzles and means for coupling said sonic energy to said casing and plug member to effect vibration thereof and from said casing and plug member to the liquid within said casing thereby to erode away the formation ahead of the casing.

7. The system of claim 6 wherein the frequency of said vibrational energy is adjusted to set up standing wave vibration of said casing.

8. The system of claim 6 and further including a wedge member attached to said plug member and preceding said casing into the ground to vibratorily effect cutting of said formation ahead of said casing.

9. The system of claim 6 and further including cutting means along said one end of said casing and extending radially outwardly from said casing for cutting a bore having a greater diameter than that of said casing.

10. The system of claim 9 wherein said cutting means comprises a plurality of teeth positioned circumferentially around said casing.

11. The system of claim 6 and further including conduit means installed in said casing and running the longitudinal extent thereof for transporting a liquid and earthen cutting mixture to the surface.

12. A method for installing a casing in an earthen formation comprising:

slideably installing a plug member for a predetermined amount of freedom of axial slidable motion on the bottom end of said casing to be driven into the formation, said plug member having jet nozzles formed therein, generating sonic energy by means of an orbiting mass oscillator, feeding liquid into the casing to establish a pressure head against said plug member, and applying said sonic energy to the casing and liquid to cause vibration thereof such that the liquid is driven from said jet nozzles in pulses in response to the sonic energy while the casing is vibratorily driven against the formation such that the liquid jet action and vibration of said casing against the formation simultaneously erode said formation ahead of said casing.

13. A system for installing a well casing in an earthen formation comprising:

a collar fastened to one end of said casing, a plug member slidably mounted within said collar for axial movement therein and forming a cover for said one casing end, said plug member having a plurality of jet nozzles formed therein, said one end of said casing being placed against the formation for penetration therein, upper and lower stop means for permitting limited axial movement of said plug member in said collar, means for generating vibrational energy at a sonic frequency, means for feeding liquid into said casing to form a fluid pressure head against said plug member so as to cause the emission of said liquid from said nozzles, and means for coupling said sonic energy to said casing to effect vibration thereof and vibration of the liquid within said casing, thereby to erode away the formation ahead of the casing.

14. The system of claim 13 and further including helical flute bar member means formed on said collar for widening the bore hole beyond the diameter of the casing and facilitating the flow of material upwardly along the wall of the casing.

* * * * *